US005126720A

United States Patent [19]

Zhou et al.

[11] Patent Number: 5,126,720

[45] Date of Patent: Jun. 30, 1992

[54] METHOD AND APPARATUS FOR DEACTIVATING MAGNETIC TARGETS

[75] Inventors: Peter Y. Zhou, Ronkonkoma; Thomas P. Solaski, Hicksville; Dexing Pang, Levittown, all of N.Y.

[73] Assignee: Knogo Corporation, Hauppauge, N.Y.

[21] Appl. No.: 642,359

[22] Filed: Jan. 17, 1991

[51] Int. Cl.[5] ..... G08B 13/14

[52] U.S. Cl. ..... 340/572; 340/551

[58] Field of Search ..... 340/551, 572; 335/306

[56] References Cited

U.S. PATENT DOCUMENTS

| | | | |
|---|---|---|---|
| 3,665,449 | 5/1972 | Elder et al. | 340/280 |
| 3,765,007 | 10/1973 | Elder | 340/572 |
| 3,780,521 | 12/1973 | Kurita et al. | 310/36 |
| 3,820,103 | 6/1974 | Fearon | 340/280 |
| 3,820,104 | 6/1974 | Fearon | 340/280 |
| 4,623,877 | 11/1986 | Buckens | 340/572 |
| 4,665,387 | 5/1987 | Cooper et al. | 340/572 |
| 4,684,930 | 8/1987 | Minasy et al. | 340/551 |
| 4,709,179 | 11/1987 | Banon et al. | 310/162 |
| 4,752,758 | 6/1988 | Heltemes | 340/572 |

FOREIGN PATENT DOCUMENTS 3014667 10/1981 Fed. Rep. of Germany .

*Primary Examiner*—Jin F. Ng
*Assistant Examiner*—Christine K. Oda
*Attorney, Agent, or Firm*—Fitzpatrick, Cella, Harper & Scinto

[57] ABSTRACT

Articles of merchandise (42) which contain deactivatable theft detection targets (44) have their targets deactivated by passing them through a box-like apparatus (30) made of low coercive force, high saturation induction material with a multiplicity of permament magnets (48) on its inside surfaces so as to generate magnetic fields which extend at different directions and at decreasing intensities from one end of the apparatus to the other so that irrespective of a target's orientation while passing through the apparatus, the target's magnetic deactivation slugs or elements will encounter a magnetizing field along the target's length sufficient to magnetize the elements.

11 Claims, 7 Drawing Sheets

Fig. 3.
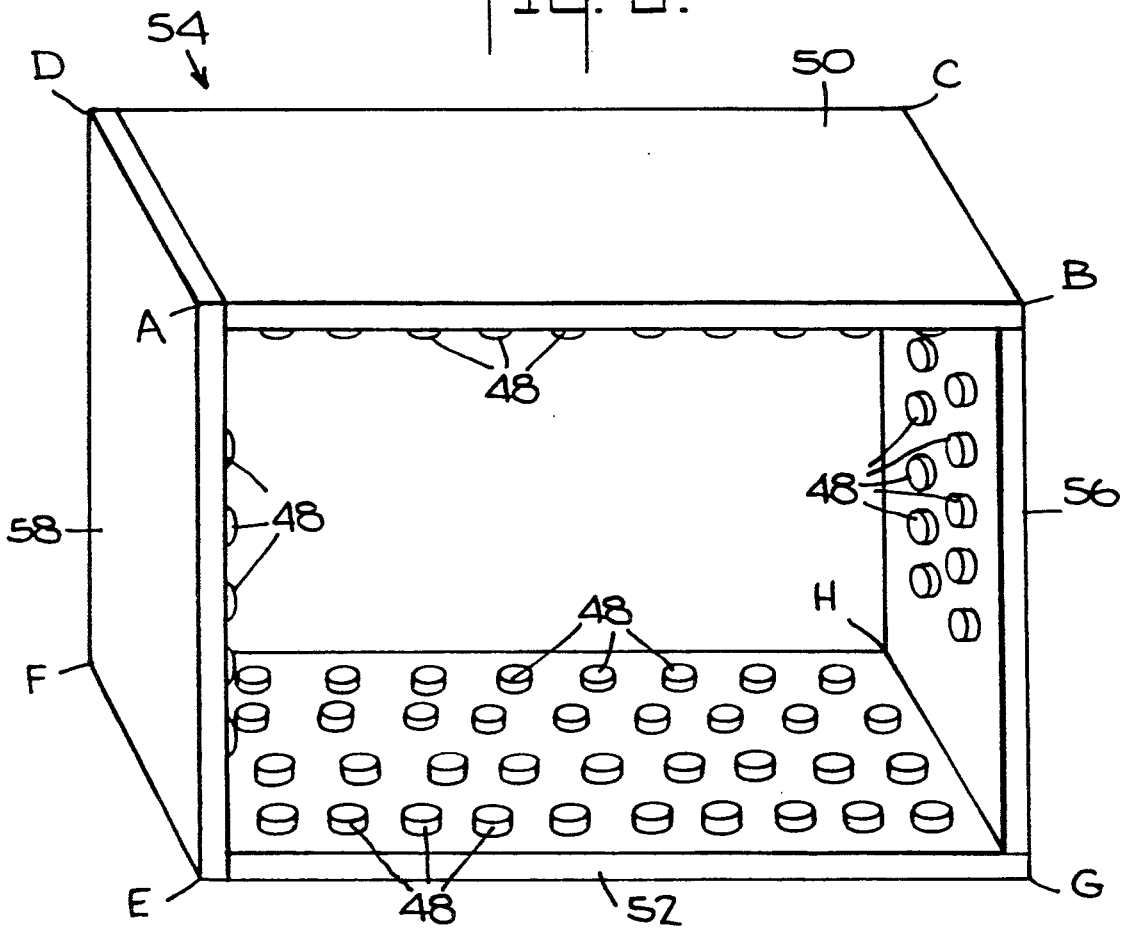
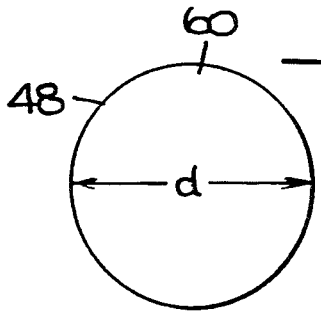
Fig. 4.
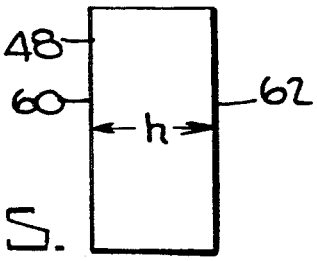
Fig. 5.
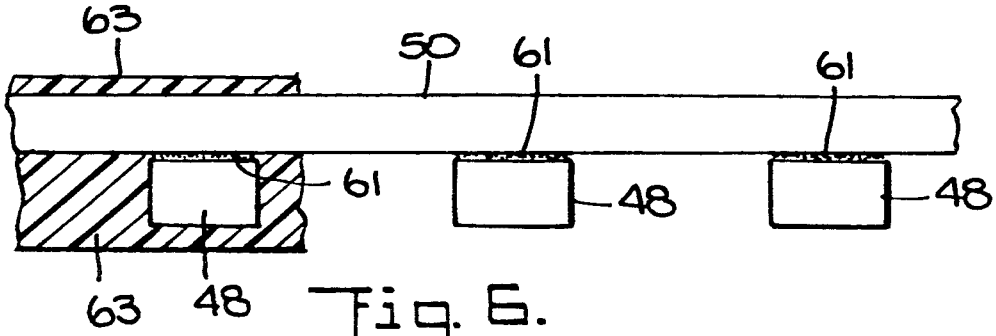
Fig. 6.

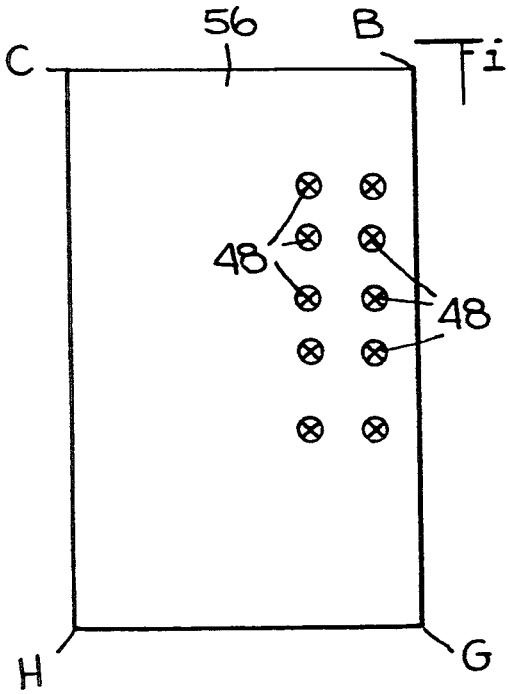
Fig. 7.
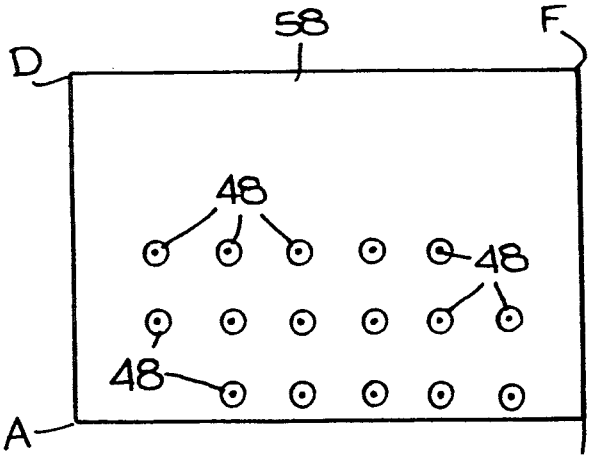
Fig. 8.
Fig. 9.
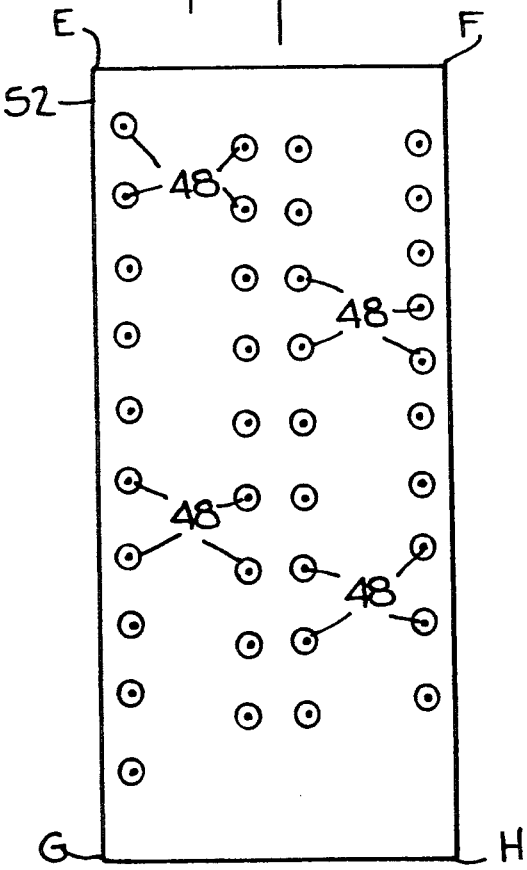
Fig. 10.
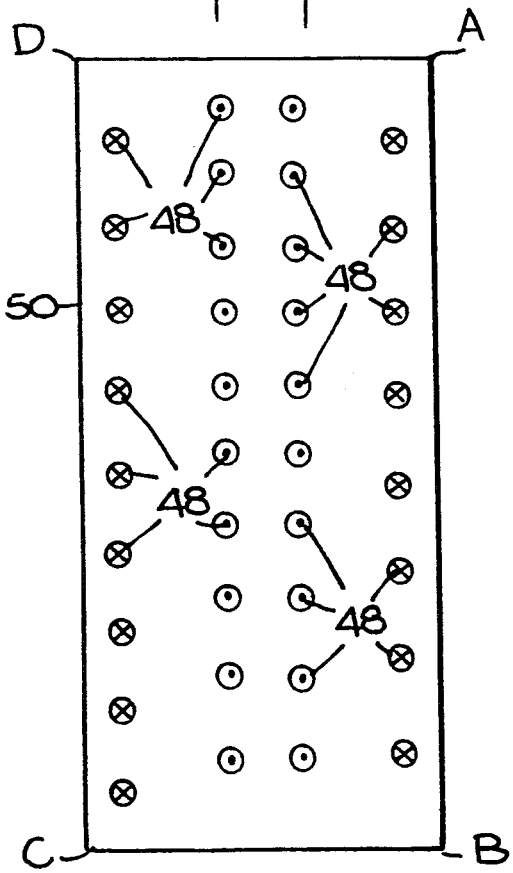

H
C
118
G
B

D
F
116
A
E

A
B
114
D
C

F
H
112
E
G

METHOD AND APPARATUS FOR DEACTIVATING MAGNETIC TARGETS

BACKGROUND OF THE INVENTION

1. Field of the Invention

This invention relates to the deactivation of magnetic targets; and in particular it concerns novel methods and apparatus for deactivating targets used to protect merchandise from shoplifting or theft.

2. Description of the Prior Art

Various types of electronic equipment are used to protect against shoplifting or theft of merchandise. One such type, which is described in U.S. Pat. No. 4,623,877 is generally referred to as a "magnetic" type of electronic article surveillance equipment. This magnetic type equipment makes use of "targets" which are thin elongated strips of high magnetic permeability, low coercivity material (e.g. Permalloy metal and certain amorphous alloys of iron, nickel or cobalt). These targets are fastened to articles to be protected. An interrogation antenna is energized to generate a continuous alternating magnetic interrogation field at each exitway from the protected area; and when a protected article is carried through the exitway it becomes exposed to the magnetic interrogation field and is driven successively into and out of magnetic saturation by the alternating magnetic interrogation field. This results in a disturbance of the interrogation field such that other magnetic fields are produced at frequencies harmonically related to the interrogation field. There is also provided at the exitway a receiver antenna and a receiver which detect these other fields and produce an alarm when a protected article is carried out through the exitway.

In order to authorize passage of an article from the protected area so that it does not cause an alarm, the target must be deactivated. One means for deactivating magnetic targets is shown and described in U.S. Pat. Nos. 4,665,387 and 4,684,930. As there shown, the target is provided with a long continuous strip of a magnetically "hard" material, i.e. a material that has sufficiently high magnetic coercivity that when it becomes magnetized by externally applied magnetic fields of sufficient intensity, it retains its magnetization. When this strip, which is known as a "collinear strip", is magnetized according to a particular pattern along its length, it prevents its associated target from producing magnetic fields at harmonic frequencies and thereby effectively deactivates the target. A problem that is encountered with the use of collinear deactivating strips is that in order to magnetize such strips the source of the magnetization must be of the particular pattern, i.e. a series of spaced north and south poles, and the source of magnetization must be placed very close to the target. Thus remote deactivation is not practical using this type of deactivation.

Other means for deactivating magnetic targets are shown and described in U.S. Pat. Nos. 3,820,103, 3,820,104 and 3,765,007. According to these patents, a magnetic target is provided with a series of spaced apart elongated elements, generally referred to as "slugs", which are shorter than the target itself and which are spaced apart from each other along the length of the target. These slugs are also of high magnetic coercivity. When the target is aligned with an external magnetic field, each of these slugs becomes magnetized along its length with each slug possessing its own north and south poles. These separate and spaced apart pole pairs magnetically bias the target so that it cannot respond effectively to interrogation fields.

The use of spaced apart magnetizable slugs permits target deactivation to be carried out with a single magnetizing field from a magnetizing device that does not touch the target. However, it necessary that the target be aligned with the deactivating magnetic field. This makes it difficult to deactivate targets on several articles of merchandise that may be in random orientation on a checkout conveyor or in a bag or box.

It has been proposed to deactivate magnetic targets which have spaced apart deactivating slugs by providing a box-like structure with magnetizing coils in various walls of the structure. When the coils are energized by passing an electric current through them, they will produce magnetic fields according to their different orientations. However, when magnetic fields are generated from coils facing in different directions, there are produced resultant fields which are different in intensity and direction at different locations. Thus unless a target at a particular location is oriented in line with or close to the direction of the resultant field at that location, the target will not be effectively deactivated.

SUMMARY OF THE INVENTION

The present invention overcomes these problems of the prior art and permits effective remote deactivation of randomly oriented magnetic targets having deactivation slugs mounted thereon.

According to one aspect of the invention there is provided a novel method for deactivating randomly oriented elongated magnetic targets having elongated magnetizable slugs distributed along their length. This novel method comprises the steps of successively subjecting the slugs of each target to magnetic fields which extend in different directions. The magnetic fields are each of sufficient intensity to magnetize the slugs along the target when the direction of the field is substantially the same as that of the target.

According to another aspect of the invention there is provided novel apparatus for deactivating randomly oriented elongated magnetic targets having elongated magnetizable slugs distributed along their length. This novel apparatus comprises means for producing magnetic fields which extend in different directions and means for successively subjecting the slugs on each target to a different one of the fields. The magnetic fields are each of sufficient intensity to magnetize the slugs along the target when the direction of the field is substantially the same as that of the target.

BRIEF DESCRIPTION OF THE DRAWINGS

FIG. 3 is a perspective view of a yoke and magnet arrangement which comprises the internal construction of the target deactivation apparatus of FIG. 1;

FIG. 4 is a plan view of a magnet used in the arrangement of FIG. 3;

FIG. 5 is an elevational view of the magnet of FIG. 4;

FIG. 6 is an enlarged fragmentary section view showing the manner in which the yoke and magnet arrangement of FIG. 3 is incorporated into the target deactivation apparatus of FIG. 1;

FIGS. 7-10 are plan views of wall elements of the yoke of FIG. 3 and showing the placement of magnets thereon;

DETAILED DESCRIPTION OF THE PREFERRED EMBODIMENTS

Figure 1:
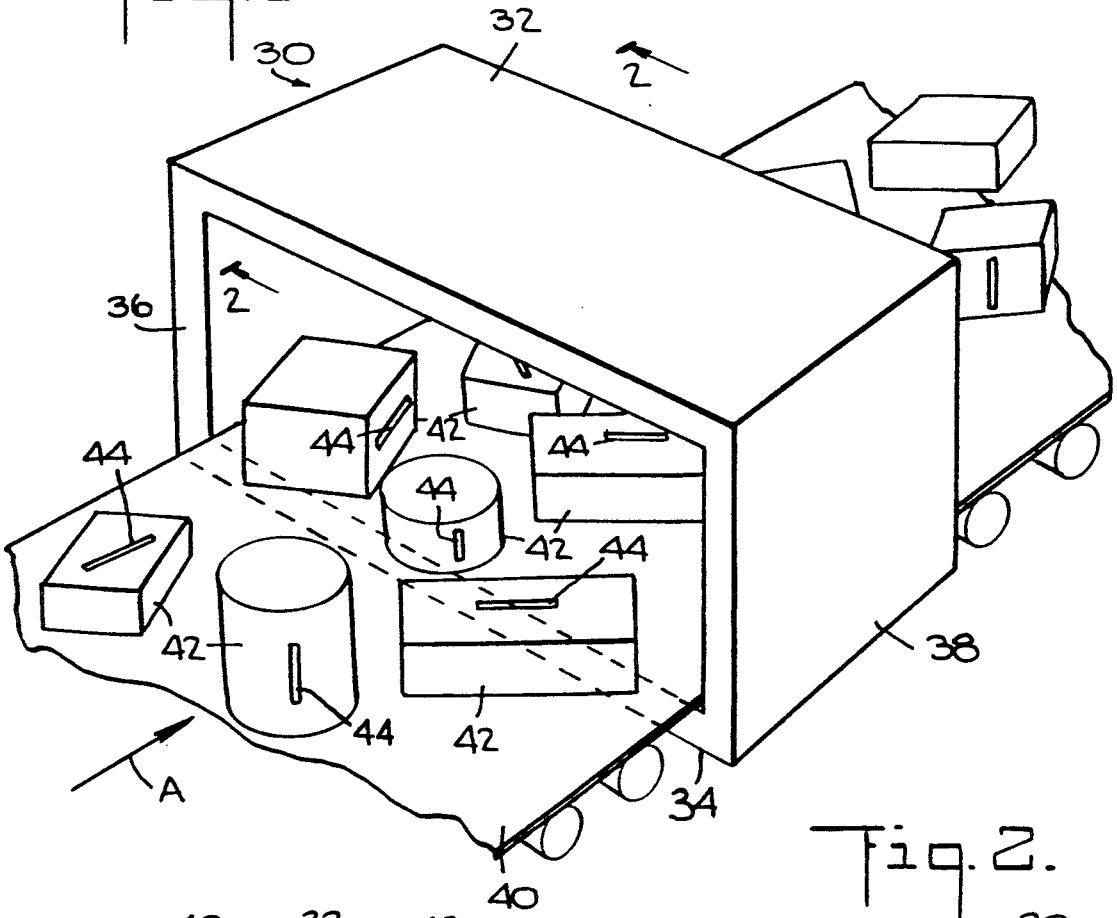
FIG. 1 is a perspective view of a target deactivation apparatus according to one embodiment of the present invention, and a conveyor for conveying articles with targets attached through the deactivation apparatus.

As shown in FIG. 1, a target deactivation apparatus 30 according to the first embodiment of the present invention is generally in the shape of a tubular, open ended box of rectangular cross section, with top and bottom walls 32 and 34 and left and right side walls 36 and 38. The apparatus 30 is open at both ends and a conveyor belt 40 passes through the apparatus, as indicated by the arrow A. The belt 40 carries articles of merchandise 42 so that they also pass through the apparatus 30. Magnetic type deactivatable targets 44 are affixed to the articles of merchandise 42. These targets are elongated strips of low magnetic coercivity, easily saturable magnetic material, which when exposed to an alternating magnetic interrogation field, are driven successively into and out of magnetic saturation and in turn produce disturbances in the form of other magnetic fields at frequencies harmonically related to that of the interrogating field. The targets each have a series of spaced apart elongated deactivation slugs in the form of high magnetic coercivity material in spaced apart arrangement thereon. When these slugs are not magnetized they have no effect on the response of the targets to the alternating magnetic interrogation fields but when they are magnetized they bias the target in a manner such that it no longer responds to the interrogation field. The targets 44 become magnetized when they pass through the deactivation device 30. As will be explained below, the deactivation device 30 produces magnetic fields which extend in various directions and which magnetize the target slugs as they pass through the device even though, as shown in FIG. 1, they are oriented in random directions.

Figure 2:
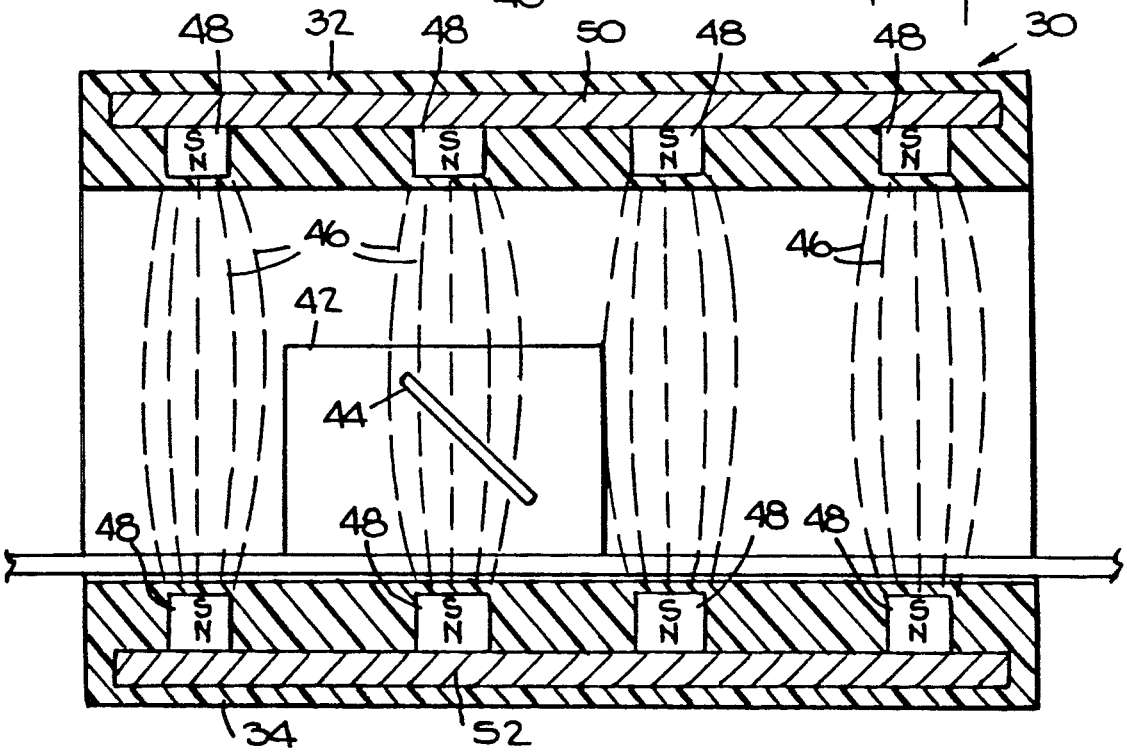
FIG. 2 is a section view taken along line 2—2 of FIG. 1.

As can be seen in the section view of FIG. 2, the interior region of the apparatus 30, through which the protected articles 42 pass, is filled with lines of magnetic flux (represented by broken lines 46). These lines of magnetic flux are generated by a multiplicity of small permanent magnets 48 inside the walls 32-38. The magnets 48 are mounted on upper and lower yoke walls 50 and 52; and together with the yoke walls, the magnets 48 are embedded within the apparatus walls 32-38.

As shown in FIG. 3 the yoke walls 50 and 52 form part of a rectangular yoke structure 54 made up of four walls, including the upper and lower walls 50 and 52, as well as right and left walls 56 and 58. These walls, which are preferably made of low carbon steel plate, are welded together to form the overall general shape of the apparatus 30. The yoke walls may be made of any low coercive force, high saturation induction material in order to efficiently concentrate the magnetic flux of the permanent magnets 48. Low carbon steel plate is used due to its low cost. The steel plate may be heat treated to improve its magnetic properties. Also, fully annealed pure iron (e.g. Armco® iron or ingot iron) may be used to obtain maximum magnetic induction in the yoke structure. Such materials would allow the use of thinner plate for the yoke and therefore minimize its overall dimensions and weight. It should be understood that any low coercive force, high saturation material could be used, such as silicon-iron, nickel-ferrite, cobalt-iron alloys, etc. Also, the yoke walls may be laminated; however, solid plates allow the maximum concentration of magnetic flux in the yoke structure.

As shown in FIG. 3, arrays of the magnets 48 are arranged on the inside facing surface of each of the yoke walls 50, 52, 56 and 58. The magnets 48, as shown in FIGS. 4 and 5, are of short cylindrical shape and are magnetized in a direction along their cylindrical axis so that one circular surface 60 is a north pole and the opposite circular surface 62 is a corresponding south pole. The magnets 48 are placed on the walls of the yoke with either their north or their south pole against the yoke wall and the opposite pole facing away from the wall.

The magnets 48 should be powerful enough to form lines of magnetic flux 46 inside the apparatus 30 which will magnetize the slugs on the targets which pass through the apparatus. Moreover, as will be explained more fully hereinafter, these lines of magnetic flux must extend in different directions at different locations inside the apparatus. This is achieved by the arrangement of the magnets 48 and the cooperative effect of the low coercive force, high magnetic saturation characteristic of the yoke walls.

The magnets 48 are preferably rare-earth (RE) permanent magnets of the formula $RE_2TM_{14}B$, where RE is the rare earth metal neodymium (Nd), TM is the transition metal iron (Fe) and B is boron. The magnets have an intrinsic coercive force, $H_{ci}$, of 10 kOe (kilooersteds) and a peak energy density, $B_dH_d$ maximum, of 30 MGOe (mega-gauss-oersteds). Acceptable magnetic properties will depend on the required magnetizing field and the size of the area or region encompassed by the apparatus. However, it is preferred that the intrinsic coercive force and peak energy density of the magnets 48 be as great as possible. Specifically, the $H_{ci}$ should be $>10$ kOe (preferably closer to 14 kOe) and the $B_dH_d$ maximum should be $>30$ MGOe. Other rare-earth permanent magnet compositions may also be used. Further, other permanent magnet materials such as those used in Alnico® magnets, Fe-Co-Cr alloy magnets, ceramic magnets, etc., may also be used, provided they are positioned and arranged to generate sufficient magnetic force to magnetize the slugs on the targets 44 passing through the deactivation apparatus 30. In the preferred embodiment, the diameter d of the magnets 48 is about 0.980 inches (2.49 cm) and the height h of the magnets is about 0.630 inches (1.60 cm). It should be understood that other magnet shapes and sizes can be used so long as they have sufficient strength to generate magnetic fields which will magnetize the target slugs.

In the preferred embodiment of FIG. 1, the internal dimensions of the target deactivation apparatus 30, i.e. the cross sectional dimensions of the passage through which the articles of merchandise 42 pass, are about 9.5 inches (24.1 cm) high and about 14 inches (35.56 cm) wide. The length of the target deactivation apparatus 30, i.e. the distance along which the articles of merchandise must move in passing through the apparatus, is about 6½ inches (16.5 cm). The size of the passage depends on the strength of the magnets 48 and the ability to arrange the magnets so that along any path through the passage, an object will successively encounter magnetic fields in substantially all directions and having sufficient intensity to magnetize target slugs which are in substantial alignment with the magnetic field. As can be seen in FIG. 6, the magnets 48 are attached to the yoke walls 50,52 56 and 58 by means of an adhesive layer 61. Actually, the magnetic adherence of the magnets to the yoke walls should be sufficient to hold the magnets in place; and the adhesive layer is merely provided as a precaution to avoid shifting of the magnets during manufacture. The adhesive layer should in any event be kept at a minimum thickness to avoid interference with the magnetic flux flowing between the magnets 48 and the yoke structure 50.

The yoke structure 50 and the magnets 48 are encased in a plastic material 63 which holds the magnets in place and yet does not appreciably interfere with the magnetic flux lines 46 inside the target deactivation apparatus 30.

FIGS. 7–10 show the placement of the magnets 48 on the various yoke walls 50, 52, 56 and 58. The dot (•) shown on some of the magnets 48 represents the magnet's north pole while the (x) shown on the other magnets represents the magnet's south magnetic pole. In addition, to more clearly relate the yoke structure 54 of FIG. 3 with the individual yoke walls 50, 52, 56 and 58 of FIGS. 7–10, the corresponding corners of the structure 54 and of the respective walls 50, 52, 56 and 58 are lettered, respectively, as A, B, C, D, E, F, G and H.

The right side wall 56 shown in FIG. 7 has a length of 9.5 inches (24.13 cm) and a width of 6.5 inches (16.51 cm). The wall also has a thickness of about 0.5 inches (1.27 cm). Ten magnets 48 are arranged on the wall 58 all with their south magnetic poles (x) facing away from the wall. The ten magnets 48 are arranged in two rows of five magnets each with the magnets in each row being equally spaced from each other beginning at a distance of about 2.2 inches (5.59 cm) from the edge BC and extending to a distance of 3.7 inches (9.40 cm) from the opposite edge HG. The first row of magnets is spaced about 0.8 inches (2.03 cm) from the wall edge BG and the second row of magnets is spaced about 1.2 inches (3.05 cm) from the first row.

The left side wall 58 shown in FIG. 8 has a length of 10.5 inches (26.67 cm) and a width of 6.5 inches (16.51 cm). The wall also has a thickness of about 0.5 inches (1.27 cm). Sixteen magnets 48 are arranged on the wall 56 all with their north magnetic poles (•) facing away from the wall. The sixteen magnets 48 are arranged in three rows, with five magnets in a first row parallel to the edge AE, six magnets in a second row parallel to and spaced from the first row, and five magnets in a third row parallel to and spaced from the second row. The five magnets in the first row are spaced equally from each other beginning at a distance of about 1.3 inches (3.30 cm) from the wall edge FE and extending to a distance of about 3.0 inches (7.62 cm) from the opposite wall edge DA. The six magnets in the second row are spaced equally from each other beginning at a distance of about 1.3 inches (3.30 cm) from the wall edge AE and extending to a distance of about 1.6 inches (4.06 cm) from the opposite wall edge DF. The five magnets in the third row are spaced equally from each other beginning at a distance of about 2.6 inches (6.60 cm) from the wall edge FE and extending to a distance of 1.6 inches (4.06 cm) from the opposite wall edge DA. The first row is spaced from the wall edge AE by about 0.6 inches (1.52 cm); the second row is spaced about 1.3 inches (3.30 cm) from the first row; and the third row is spaced about 0.7 inches (1.78 cm) from the second row.

The bottom wall 52 shown in FIG. 9 has a length of 14.5 inches (36.83 cm) and a width of 6.5 inches (16.51 cm). The bottom wall also has a thickness of about 0.5 inches (1.27 cm). Thirty eight magnets 48 are arranged on the wall 52 all with their north poles (•) facing away from the wall. The thirty eight magnets 48 are arranged in four rows, with ten magnets in a first row parallel to the edge GE, nine magnets each in second and third rows parallel to and spaced from the first row and ten magnets in a fourth row parallel to and spaced from the other rows. The ten magnets in the first row are spaced equally from each other beginning at a distance of about 1.5 inches (3.81 cm) from the wall edge GH and extending to a distance of about 2.8 inches (7.11 cm) from the opposite wall edge EF. The nine magnets in each of the second and third rows are spaced equally from each other beginning at a distance of about 1.5 inches (3.81 cm) from the wall edge GH and extending to a distance of about 2.5 inches (6.35 cm) from the opposite wall edge EF. The ten magnets in the fourth row are spaced equally from each other beginning at a distance of about 1.2 inches (3.05 cm) from the wall edge GH and extending to a distance of 1.7 inches (4.32 cm) from the opposite wall edge EF. The first row is spaced from the wall edge GE by about 0.5 inches (1.27 cm); the second row is spaced about 2.2 inches (5.59 cm) from the first row; the third row is spaced about 1.1 inches (2.79 cm) from the second row; and the fourth row is spaced about 2.2 inches (5.59 cm) from the third row.

The top wall 50 shown in FIG. 10 has a length of 14.5 inches (36.83 cm) and a width of 6.5 inches (16.51 cm). The top wall also has a thickness of about 0.5 inches (1.27 cm). Thirty seven magnets 48 are arranged on the wall 52 in four parallel rows. The south poles (x) of the magnets of the first and fourth rows (i.e. the outermost rows) face away from the wall and the north poles (•) of the magnets of the second and third rows (i.e. the innermost rows) face away from the wall. The first row contains eight magnets equally spaced from each other beginning at a distance of about 1.6 inches (4.06 cm) from the wall edge DA and extending to a distance of about 1.7 inches (4.32 cm) from the opposite wall edge CB. The second and third rows each contain ten magnets and the magnets in each of these rows are spaced equally from each other beginning at a distance of about 1.0 inches (2.54 cm) from the wall edge DA and extending to a distance of about 1.6 inches (4.06 cm) from the opposite wall edge CB. The fourth row contains ten magnets which are spaced equally from each other beginning at a distance of about 1.6 inches (4.06 cm) from the wall edge DA and extending to a distance of 1.4 inches (3.56 cm) from the opposite wall edge CB.

The first row is spaced from the wall edge AB by about 0.7 inches (1.78 cm); the second row is spaced about 2.0 inches (5.08 cm) from the first row; the third row is spaced about 1.2 inches (3.05 cm) from the second row; and the fourth row is spaced about 2.0 inches (5.08 cm) from the third row.

The magnets 48, together with the yoke structure 54 and the space surrounded by the yoke structure walls 50, 52, 56 and 58, form a magnetic circuit which directs lines of magnetic flux in various directions and at various concentrations or intensities throughout the space surrounded by the yoke structure walls. The specific direction and intensity of the magnetic flux at any location is dependent on the arrangement and spacing of the magnets 48. Basically, the pattern of these magnetic flux lines is chosen such that as a target moves along any path through the deactivation apparatus 30, the target will successively encounter magnetic flux lines which are oriented in different directions; so that at one location along the path the target will encounter magnetic flux lines that extend substantially along the length of the target. Also the intensity of the fields associated with these flux lines is sufficient to magnetize the slugs on the target along their length when the flux lines extend substantially along the target length. In addition, as will be explained further below, the intensity of the magnetic field associated with the flux lines at each successive location along the path of target movement is less than the intensity of the magnetic field at the preceding locations; although, as indicated, the intensity at each location is sufficient to magnetize the slugs on the target along their length when the flux lines extend substantially along the target length.

While it may be possible to mathematically formulate the positioning of the magnets 48 which will produce the magnetic flux pattern described above, from a practical point, it is more convenient simply to empirically arrive at this pattern by shifting the magnets 48 on the yoke structure walls until the pattern is realized.

Figure 11:
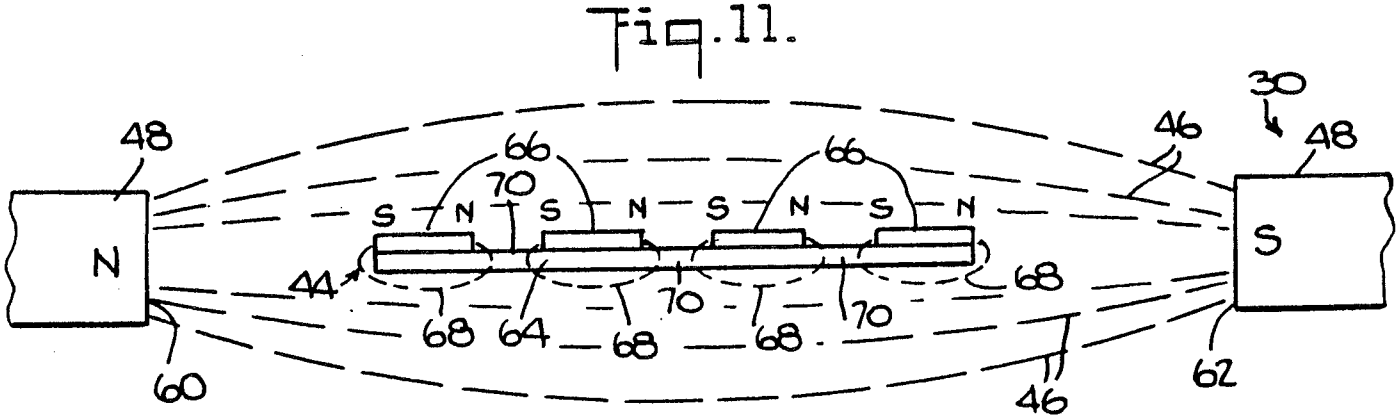
FIG. 11 is a side elevational view of a deactivatable target in a magnetic deactivating field.

FIGS. 11–14 show the manner in which a target 44 becomes deactivated in the apparatus 30 of the present invention. As shown in FIG. 11, a target 44 includes an elongated active strip 64 of a low coercivity low saturation induction material such as Permalloy. Certain amorphous alloys of iron, nickel or cobalt may also be used for the active strip 64. The strip 64 may be from 1.5 inches (3.81 cm) to 7 inches (17.78 cm) in length. Its cross section should be as small as possible, e.g., 0.0625–0.125 inches (1.59–3.17 mm) wide and 0.001–0.006 inches (0.025–0.152 mm) thick. Mounted on the active strip 64 in spaced apart array are several elongated deactivation slugs 66. These slugs are of a high magnetic coercivity material that retains its magnetization after being subjected to a magnetic field. A suitable material for the slugs is sold under the trademark CROVAC 110 by Vacuumschmelze GmbH of Hannau and Berlin, Germany. When the slugs 66 are magnetized along their length, they produce magnetic flux lines 68 which extend between their north and south poles. These magnetic flux lines bias portions 70 of the active strip 64 into magnetic saturation so that those portions cannot be driven into and out of saturation by an alternating magnetic interrogation field. The strip 64 is thus effectively separated into several very short strips that are incapable of producing detectable responses to a magnetic interrogation field.

The slugs 66 become magnetized when they are subjected to a magnetic field of sufficient strength along their length to bias them into magnetic saturation. This occurs when the slugs are positioned so that they extend substantially in line with the lines of magnetic flux between opposite pole faces of the magnets 48 of the target deactivation apparatus 30, as shown in FIG. 11. After the target 44 is removed from the apparatus, the slugs 66 retain this magnetization and maintain the target deactivated.

As pointed out above, when targets 44 are attached to articles of merchandise moving along a conveyor belt or packaged in a bag or a box, the targets are oriented randomly and it cannot be expected that all of the targets would be aligned with the lines of flux corresponding to a given magnetic field. However, with the present invention the target is successively subjected to lines of magnetic flux that extend in different directions relative to the target length; and one of these directions is substantially in line with the target. At this point the slugs on the target become magnetized along their length and the target is deactivated.

Figure 14:
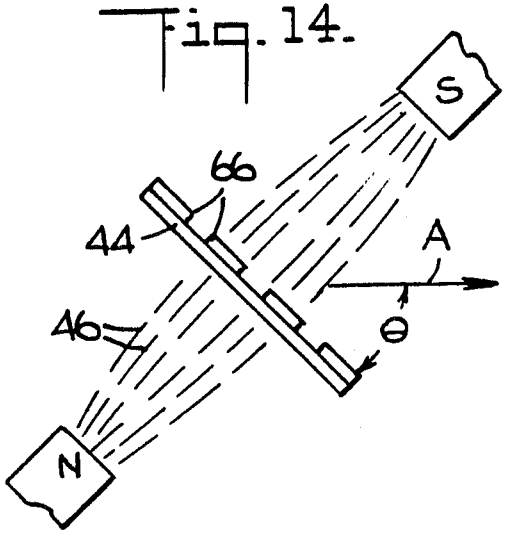
FIGS. 12-14 are diagrams showing a target of fixed orientation encountering magnetic fields of different orientations.
Figure 13:
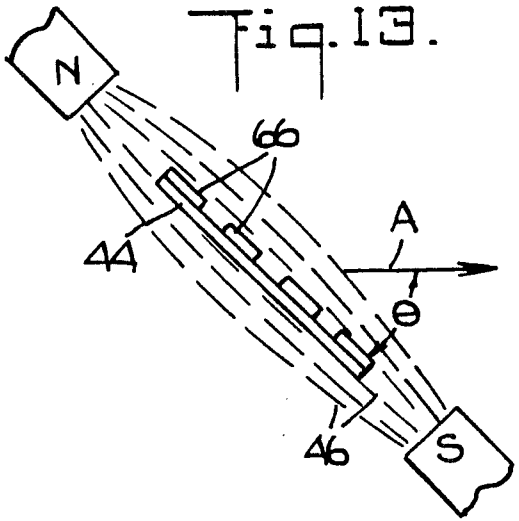
Figure 12:
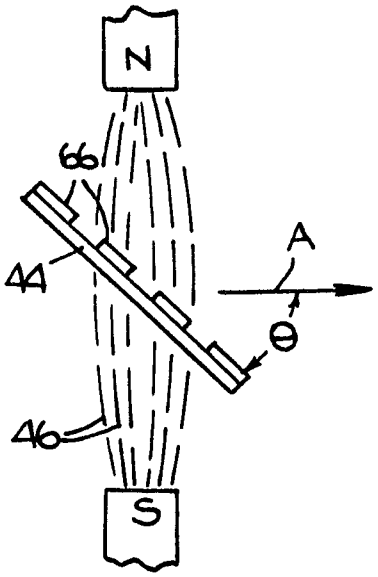

FIGS. 12, 13 and 14 show the effect of magnetic fields corresponding to magnetic flux lines in successively different directions on a target 44 moving along a given path A and oriented at an angle $\Theta$ relative to the path A. FIG. 12, shows the target first encountering magnetic flux lines that are generally perpendicular to the path A. These flux lines have a component parallel to the target and a component perpendicular to the target; and depending on the angle of the target relative to the flux lines and the intensity of the flux lines, they may magnetize the slugs 66 either along their length or across their thickness.

When the target 44 is subsequently subjected to magnetic flux lines substantially in line with the length of the target, as shown in FIG. 13, the elongated slugs 66 on the target are also in line with the flux lines. The preferred direction of magnetization of the slugs is along their length rather than across their width or thickness. Therefore, the slugs 66 become magnetized along their length at this point and any prior magnetization across the thickness or width of the slugs is removed.

The target 44 may subsequently become subjected to magnetic flux lines that are perpendicular to the target 44 as shown in FIG. 14. However, as indicated above, the preferred direction of magnetization of the target slugs is along their length; and therefore, provided that the intensity of the magnetic flux lines in the direction shown in FIG. 14 is not substantially greater than the intensity of the flux lines in the direction shown in FIG. 13 they will not change the magnetization along the length of the slugs.

It has been found that by arranging the magnets 48 so that the lines of magnetic flux are gradually decreased in intensity from the entering end of the target deactivation apparatus 30 to the exit end, the magnetization produced along the length of the slugs at any location within the deactivation apparatus 30 will not be adversely affected by the subsequently encountered magnetic fields. Of course, the lines of magnetic flux at the exit end of the target deactivation apparatus 30 must in any case be of sufficient intensity to magnetize target slugs if they are in line with those lines of magnetic flux at the exit end of the deactivation apparatus.

Figure 15:
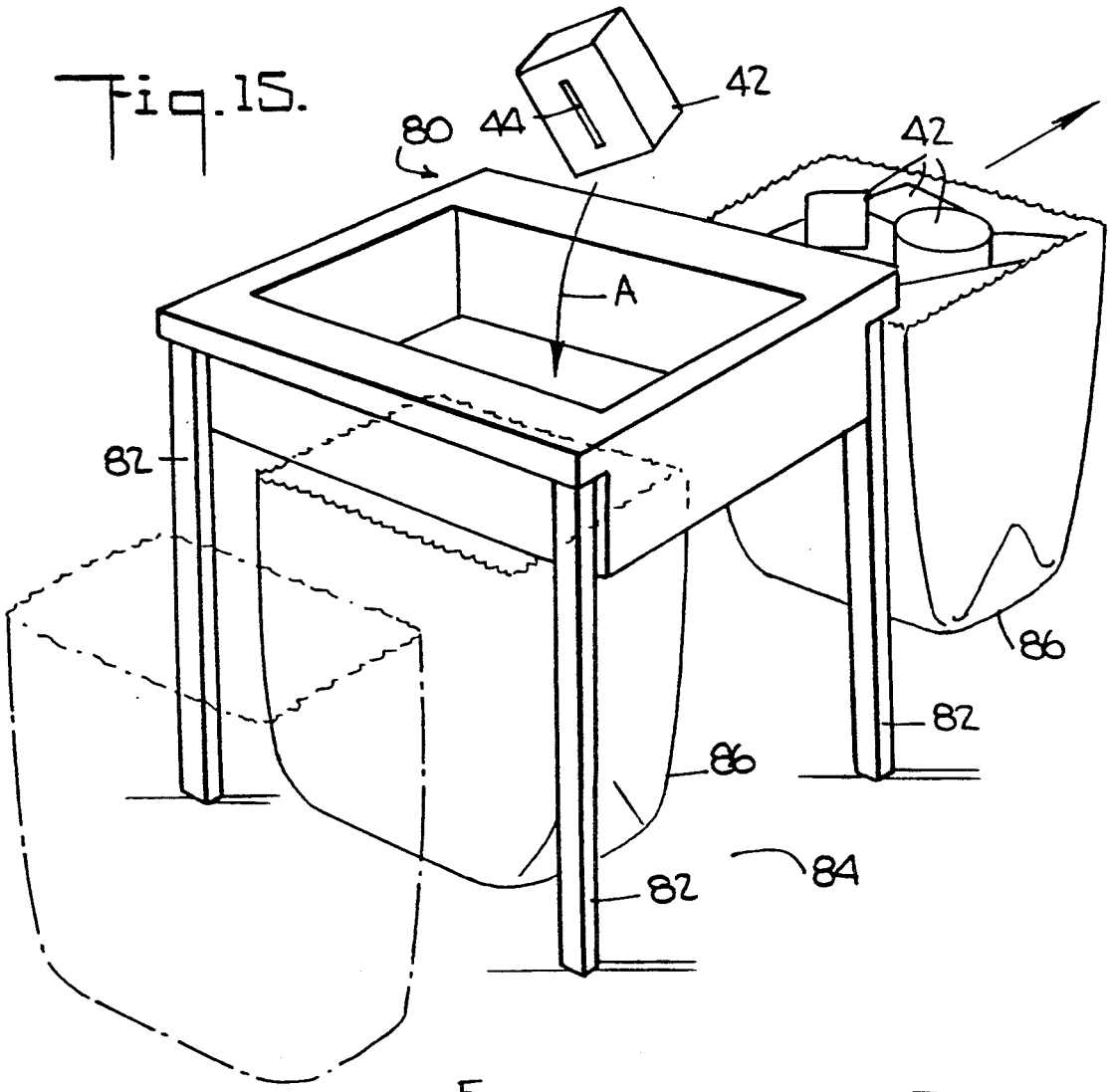
FIG. 15 is a perspective view showing a target deactivator apparatus constituting a second embodiment of the invention.

FIG. 15 shows a second embodiment of the invention which is suitable for deactivation of targets on merchandise which has been put in a package or a bag. As shown in FIG. 15 there is provided a tubular shaped target deactivation apparatus 80 which is of similar construction to the deactivation apparatus 30 of the preceding embodiment. However, in the embodiment of FIG. 15, the apparatus 80 is turned so that the path of passage A through the apparatus is vertical rather than horizontal. The deactivation apparatus 80 is mounted on legs 82 at each corner thereof, so that the apparatus is maintained at a sufficient distance above a table or counter 84 to permit bags 86 or other containers to be moved into position under the deactivation apparatus.

As shown in FIG. 15, a bag 86 is moved into position under the deactivation apparatus 80. Then, articles of merchandise 42 with targets 44 attached thereto are loaded into the bag through the deactivation apparatus. As each target passes through the deactivation apparatus it becomes subjected to magnetic fields of successively different orientation; and at some location along the passage through the deactivation apparatus, the target 44 comes into substantial alignment with one of the magnetic fields. At that point the slugs on the target become magnetized along their length and the target is thereby deactivated. When the bag 86 has been loaded, it is removed from under the deactivation apparatus 80.

It should be noted that the bag 86 is not brought back up through the target deactivation apparatus but instead is removed from under the apparatus. This is to avoid subjecting the targets again to the magnetic fields of the deactivation apparatus. As mentioned above, the magnets in the deactivation apparatus are arranged such that the intensity of the fields they produce decrease in intensity from the entrance end to the exit end of the apparatus. This is to avoid possible cross magnetization of the target slugs by high intensity cross oriented magnetic fields at the exit end. If the bag 86 were to be removed by pulling it up through the deactivation apparatus, the targets would become subjected to high intensity fields as they exited from the apparatus and their deactivation slugs could thereby become cross magnetized.

Figure 16:
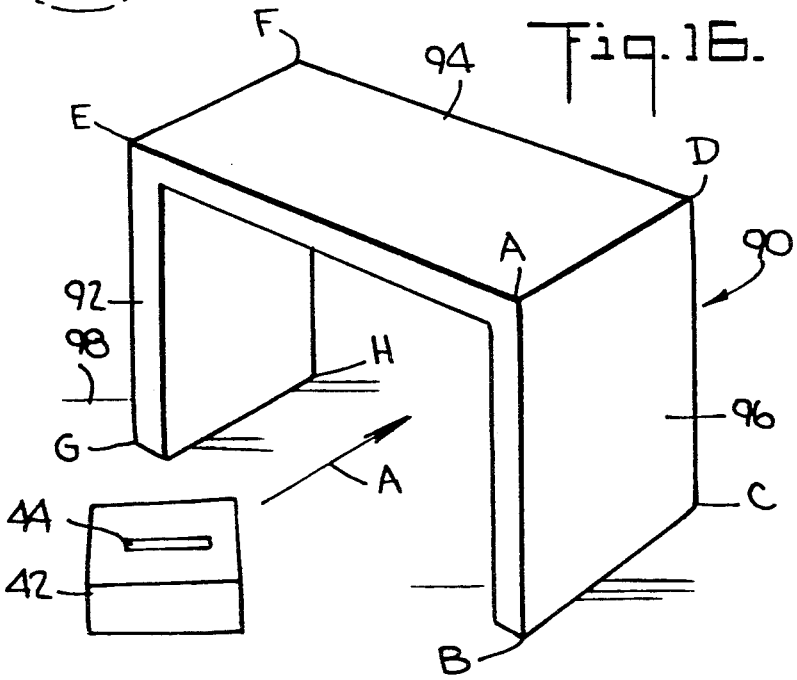
FIG. 16 is a perspective view showing a target deactivator apparatus constituting a third embodiment of the invention.

FIG. 16 shows a still further embodiment of the present invention according to which a target deactivation apparatus 90 is made up of three walls 92, 94 and 96. The apparatus is set on a table 98 or other surface and forms with that surface a passageway through which articles of merchandise 42 with targets 44 attached can pass. Inside the walls 92, 94 and 96 is a yoke and magnets as described above in connection with the preceding embodiments. The magnets are arranged such that at different locations along a path A through the passageway, the targets 44 on the articles of merchandise 42 become subjected successively to magnetic fields of different orientation. It should be understood that because the deactivation apparatus has only three sides, the magnetic fields produced along the passageway through the apparatus are not as intense as in the case of a deactivation apparatus of four sides. However the apparatus of FIG. 16 has the advantage of greater portability; and where a large passageway is not needed this embodiment may be preferred.

Figures 17, 18, 19, 20:
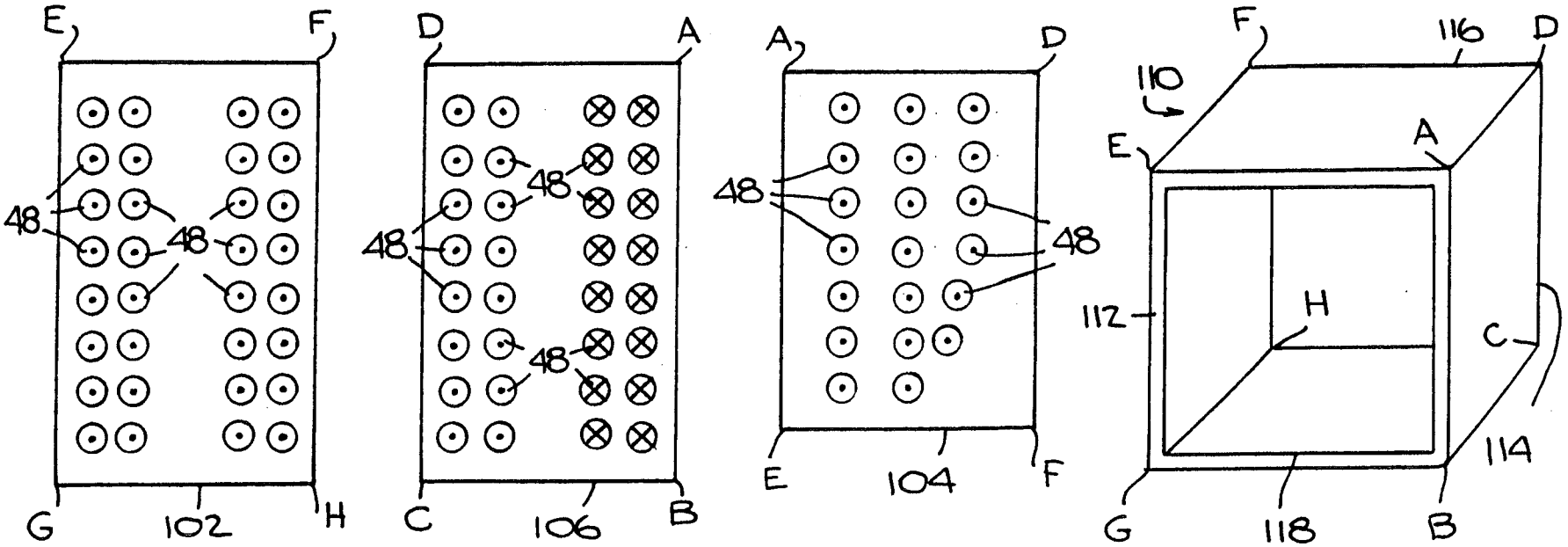
FIGS. 17-19 are plan views showing the arrangements of magnets on the yoke walls of the embodiment of FIG. 16.
FIG. 20 is a perspective view of a yoke arrangement for a target deactivator apparatus of the percent invention wherein the yoke has a square cross section.

FIGS. 17–19 show the arrangement of magnets 48 on yoke walls 102, 104 and 106 within the walls 92, 94 and 96, respectively, of the embodiment of FIG. 16. In the embodiment of FIG. 16, the side yoke walls 102 and 106 are chosen to have a height of 11 inches (27.94 cm) and a length of 6.5 inches (16.51 cm) and the top yoke wall 104 is chosen to have a length of 9 inches (22.86 cm) and a length of 6.5 inches (16.51 cm). The corners of the various yoke walls correspond to the like lettered wall corners A, B, C, D, E, F, G and H in FIG. 16. The thickness of the walls is about 0.5 inches (1.27 cm).

As shown in FIG. 17, the side yoke wall 102 has four rows of magnets 48 each extending from the wall edge EF to the wall edge GH. Each row contains eight equally spaced magnets arranged with the north pole (•) of each magnet facing away from the yoke wall. The outermost rows of magnets are arranged close to the wall edges EG and FH respectively, and the innermost rows are each arranged along lines slightly more than one quarter of the distance inwardly from the wall edges EG and FH.

As shown in FIG. 18, the side yoke wall 106 has four rows of magnets 48 each extending from the wall edge DA to the wall edge CB. Each row contains seven equally spaced magnets arranged with the north pole (•) of each magnet in the two rows closest to the wall edge DC facing away from the yoke wall and the south pole (x) of each magnet in the two rows closest to the wall edge AB facing away from the yoke wall. The outermost rows of magnets are arranged close to the wall edges DC and AB respectively, and the innermost rows are each arranged along lines slightly more than one quarter of the distance inwardly from the wall edges DC and AB.

As shown in FIG. 19, the top yoke wall 104 has three rows of magnets 48 each extending from the wall edge AD to the wall edge EF and each arranged with its north pole (•) facing away from the wall. A first row of seven equally spaced magnets extends parallel to the wall edge AE and is located about one fourth of the distance from the wall edge AE to the wall edge DF. A second row of equally spaced magnets extends parallel to the first row and is located midway between the wall edge AE and the wall edge DF. The third row of magnets comprises six magnets, the first four of which are equally spaced from each other along a line extending parallel to the other rows and located about three fourths of the distance from the wall edge AE to the wall edge DF. However these first four magnets are all located along the half of this last mentioned line closest to the wall edge AD. The remaining two magnets in the third row are also spaced along the last mentioned line but are successively closer to the second row. This arrangement of magnets provides a succession of differently oriented magnetic fields along the path A through the deactivation apparatus as shown in FIG. 16, with the intensity of the fields gradually diminishing along the path.

FIG. 20 shows a yoke structure 110 according to another embodiment of the invention. The yoke structure 110 is made up of four walls 112, 114, 116 and 118 of equal size so as to form a square cross section. Each wall is of the same material and thickness as in the preceding embodiments and is about 11 inches (27.9 cm) long and about 6.5 inches (16.51 cm) wide.

The arrangement of the magnets on the walls 112, 114, 16 and 118 is shown in the plan views of the walls in FIGS. 21, 22, 23 and 24. Also, to relate the wall edges in FIGS. 21–24 to those in FIG. 20, the corresponding corners of the yoke structure 124 and of the walls 112–118 are lettered respectively as A, B, C, D, E, F, G and H.

Figures 21, 22, 23, 24:
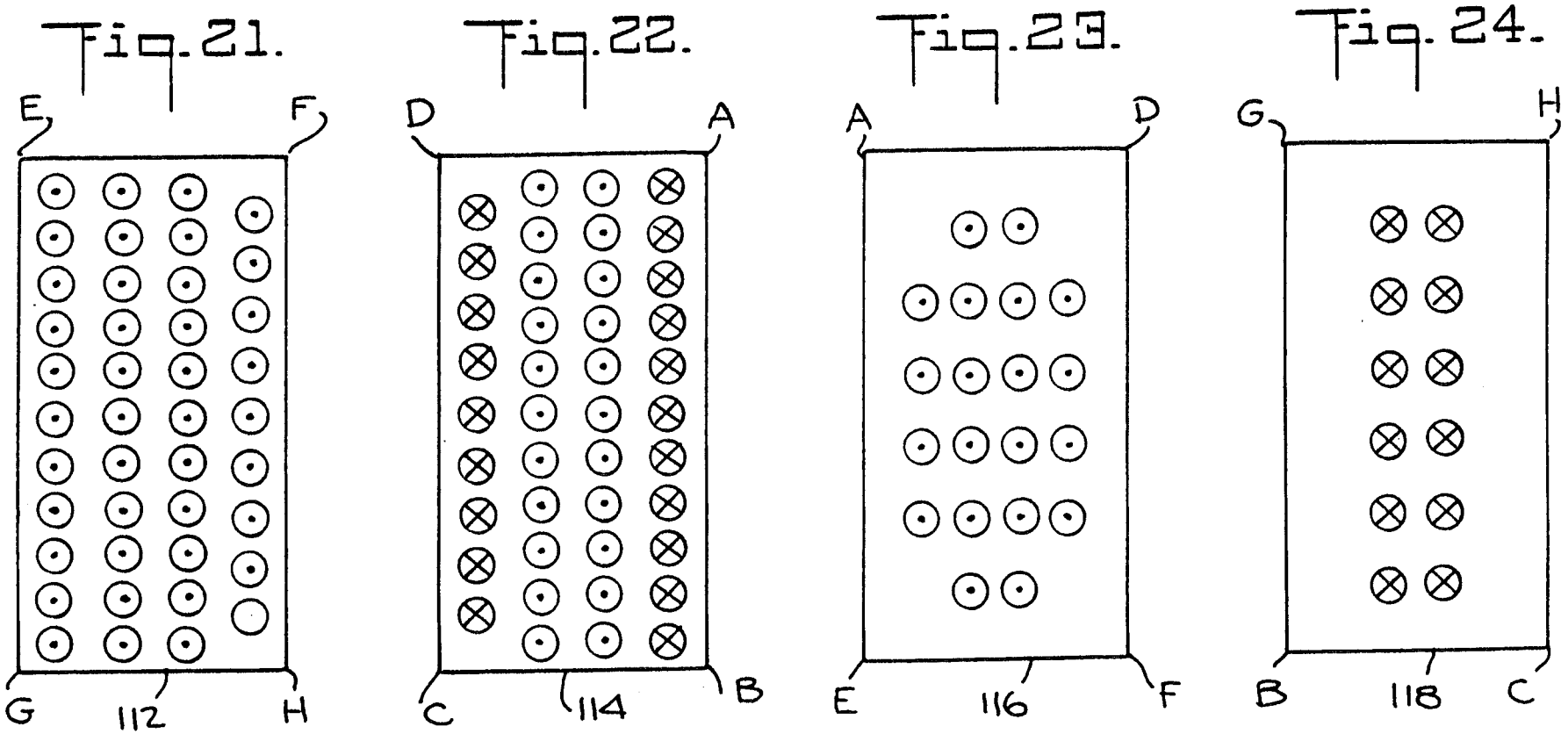
FIGS. 21-24 are plan views showing the arrangements of magents on the yoke walls of the yoke of FIG. 20.

As shown in FIG. 21, the magnets 48 on the wall 112 are arranged in four parallel rows, each extending from the wall edge EF to the opposite wall edge GH, with the magnets in each row equally spaced along the row. All of the magnets 48 on the wall 112 are arranged with to their north poles (•) facing away from the wall. The rows themselves are equally spaced from each other between the wall edges EG and FH. The row closest to the edge FH contains nine equally spaced magnets and the other rows each contain eleven equally spaced magnets.

As shown in FIG. 22, the magnets 48 on the wall 114 are arranged in four parallel rows each extending from the wall edge DA to the opposite wall edge CB with the magnets in each row equally spaced. The magnets in the rows closest to the wall edges DC and AB are all arranged with their south poles (x) facing away from the wall and the other magnets are all arranged with their north poles (•) facing away from the wall. The outer rows are each located close to their respective wall edges DC and AB while the inner rows are located close to each other along a line midway between the edges DC and AB. Each row contains eleven magnets.

As shown in FIG. 23, the magnets 48 on the wall 116 are arranged in four parallel rows each extending from the wall edge AD to the opposite wall edge EF. All of the magnets are arranged with their north pole (•) facing away from the wall. The two innermost rows are close to and extend along opposite sides of a line parallel to and midway between the wall edges AE and DF. These two innermost rows each contain six magnets. The outermost rows are located adjacent to the innermost rows and contain four magnets each. These four magnets are positioned close to the middle four magnets of their respectively aligned rows.

As shown in FIG. 24, the magnets 48 on the wall 118 are arranged in two parallel rows, each closely positioned to and extending along a line parallel to and midway between the wall edges BG and CH. Each rows contains six equally spaced magnets and each magnet is arranged with its south pole (x) facing away from the wall 118.

The arrangement of magnets in each embodiment have been chosen to produce in the passageway through the deactivation apparatus, a magnetic field pattern such that an object passing along any given path through the apparatus will successively encounter magnetic fields of various orientation and will, somewhere along the path, encounter a magnetic field oriented in substantial alignment with a target on the object so as to magnetize deactivation slugs on the target.

As mentioned above, the various magnet arrangements shown herein have been determined empirically. It is believed that other arrangements would also provide satisfactory results. Also, some variations in the positioning of the magnets described herein can be tolerated; however, in general, the magnets should be kept within 0.0625 inches (1.59 mm) of the positions described for best results.

While permanent magnets are presently preferred, the principles of the present invention could be achieved by using a plurality of electromagnets of the same strength and arrangement as the permanent magnets.

It will be appreciated that the present invention provides a simple and convenient method and apparatus for deactivating randomly oriented targets.

We claim:

1. A method for deactivating randomly oriented elongated magnetic targets having elongated magnetizable slugs distributed along their length, said method comprising the steps of successively subjecting the slugs of each target to magnetic fields of successively reduced intensity which extend in different directions, each of said magnetic fields being of sufficient intensity to magnetize the slugs along a target sufficiently to deactivate the target when the direction of the field is substantially the same as that of the target.

2. The method according to claim 1 wherein said magnetic fields are distributed along a given path and said targets are moved along said path.

3. The method according to claim 1 or 2 wherein said magnetic fields extend in substantially all directions.

4. A method according to claim 3 wherein the intensity and direction of each magnetic field is maintained substantially constant during target deactivation.

5. An apparatus for deactivating randomly oriented elongated magnetic targets having elongated magnetizable slugs distributed along their length, said apparatus comprising means for producing magnetic fields which extend in different directions and means for successively subjecting the slugs on each target to a different one of said fields, each of said magnetic fields being of sufficient intensity to magnetize the slugs along a target sufficiently to deactivate the target when the direction of the field is substantially the same as that of the target, said means for producing said magnetic fields being constructed and arranged to generate fields of successively reduced intensity along a given path.

6. The apparatus according to claim 5 wherein said means for producing magnetic fields is constructed and arranged to produce fields which extend at said different directions at successive locations along said path, and along which path said targets may be moved.

7. The apparatus according to claim 5 or 6 wherein said means for producing magnetic fields is constructed and arranged to produce fields which extend in substantially all directions.

8. The apparatus according to claim 7 wherein said means for producing magnetic fields is constructed and arranged to maintain the intensity and direction of each magnetic field substantially constant during target deactivation.

9. The apparatus according to claim 7 wherein said means for producing magnetic fields comprises a plurality of spaced apart permanent magnets.

10. Apparatus according to claim 9 wherein said permanent magnets are mounted on a wall of low coercive force, high saturation induction material yoke.

11. Apparatus according to claim 9 wherein said apparatus comprises a yoke made up of walls of low coercive force, high saturation induction material and wherein said magnets are spaced apart on each of said walls.

* * * * *